US009086233B2

(12) United States Patent
Chun et al.

(10) Patent No.: US 9,086,233 B2
(45) Date of Patent: Jul. 21, 2015

(54) CONTROL METHOD OF REFRIGERATOR

(75) Inventors: Chan Ho Chun, Seoul (KR); Sung Ho Park, Seoul (KR); Chel Woong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1316 days.

(21) Appl. No.: 12/593,492

(22) PCT Filed: Jan. 26, 2008

(86) PCT No.: PCT/KR2008/000489

§ 371 (c)(1),
(2), (4) Date: Feb. 17, 2010

(87) PCT Pub. No.: WO2008/120861

PCT Pub. Date: Oct. 9, 2008

(65) Prior Publication Data

US 2010/0154443 A1 Jun. 24, 2010

(30) Foreign Application Priority Data

Mar. 29, 2007 (KR) ..... 10-2007-0031065

(51) Int. Cl.
*F25D 21/00* (2006.01)
*F25D 21/06* (2006.01)
(Continued)

(52) U.S. Cl.
CPC ..... *F25D 29/00* (2013.01); *F25D 21/006* (2013.01); *F25D 21/08* (2013.01); *F25B 5/02* (2013.01); *F25B 2600/2511* (2013.01); *F25D 17/065* (2013.01); *F25D 2317/0682* (2013.01);
(Continued)

(58) Field of Classification Search
CPC .... F25B 2600/2511; F25B 5/02; F25D 21/08; F25D 2700/123
USPC ..... 62/128, 140, 152, 155, 156, 234
See application file for complete search history.

(56) References Cited

U.S. PATENT DOCUMENTS 5,201,185 A * 4/1993 Hanson et al. ..... 62/81
5,222,368 A * 6/1993 Hanson ..... 62/126
(Continued)

FOREIGN PATENT DOCUMENTS

JP 2000-088440 3/2000
JP 2000-121232(A) 4/2000
(Continued)

OTHER PUBLICATIONS

International Search Report dated May 23, 2008.

*Primary Examiner* — Alexandra Elve
*Assistant Examiner* — Henry Crenshaw
(74) *Attorney, Agent, or Firm* — KED & Associates LLP

(57) ABSTRACT

A method of controlling a refrigerator is provided. The refrigerator may include a main body having a plurality of storage chambers, a plurality of evaporators to independently cool the plurality of storage chambers, and a refrigerant control valve that controls refrigerant flow into the plurality of evaporators. The method may include opening the control valve and allowing refrigerant to flow into at least one of the plurality of evaporators, when an opening integration time of the control valve is greater than a defrost setting time of the evaporator, operating the refrigerator in a defrost mode, and, when a temperature sensed by a defrost sensor of an evaporator being defrosted is greater than return setting temperatures, terminating operation in the defrost mode. In this manner, each evaporator may be defrosted efficiently, and at a point in time at which defrosting is required.

8 Claims, 6 Drawing Sheets

(51) Int. Cl.

| | |
|---|---|
| ***F25B 5/00*** | (2006.01) |
| ***F25B 49/00*** | (2006.01) |
| ***F25D 29/00*** | (2006.01) |
| ***F25D 21/08*** | (2006.01) |
| *F25B 5/02* | (2006.01) |
| *F25D 17/06* | (2006.01) |

(52) U.S. Cl.
CPC ..... *F25D2700/122* (2013.01); *F25D 2700/123* (2013.01); *F25D 2700/14* (2013.01)

(56) References Cited

U.S. PATENT DOCUMENTS

| | | | | |
|---|---|---|---|---|
| 5,816,054 | A * | 10/1998 | Yoo et al. | 62/80 |
| 6,032,471 | A * | 3/2000 | Choi | 62/153 |
| 6,205,800 | B1 * | 3/2001 | Topper et al. | 62/156 |
| 6,354,093 | B2 * | 3/2002 | Davis et al. | 62/89 |
| 6,622,498 | B2 * | 9/2003 | Park et al. | 62/154 |
| 6,931,870 | B2 * | 8/2005 | Kim et al. | 62/198 |
| 7,003,967 | B2 * | 2/2006 | Rafalovich et al. | 62/153 |
| 8,250,875 | B2 * | 8/2012 | Rafalovich et al. | 62/196.4 |
| 2001/0047657 | A1 | 12/2001 | Cho et al. | |
| 2002/0166331 | A1 * | 11/2002 | Park et al. | 62/151 |
| 2003/0070443 | A1 * | 4/2003 | Hanson et al. | 62/230 |
| 2005/0011205 | A1 * | 1/2005 | Holmes et al. | 62/156 |
| 2005/0172665 | A1 * | 8/2005 | Kim et al. | 62/525 |
| 2006/0117768 | A1 * | 6/2006 | Lee et al. | 62/151 |
| 2006/0144063 | A1 * | 7/2006 | Oh | 62/200 |
| 2006/0218946 | A1 * | 10/2006 | Davern et al. | 62/155 |
| 2006/0254308 | A1 * | 11/2006 | Yokoyama et al. | 62/500 |

FOREIGN PATENT DOCUMENTS

| | | |
|---|---|---|
| KR | 10-2001-0030430 | 4/2001 |
| KR | 10-2002-0016503 | 3/2002 |
| KR | 10-2004-0061324 | 7/2004 |

* cited by examiner

CONTROL METHOD OF REFRIGERATOR

TECHNICAL FIELD

The present invention relates to a method of controlling a refrigerator, in which a plurality of storage chambers is independently cooled by a plurality of evaporators and, more particularly, to a method of controlling a refrigerator, in which the defrosting of a plurality of evaporators is performed on the basis of an opening integration time of a refrigerant control valve for controlling refrigerant introduced into the evaporators.

BACKGROUND ART

In general, a refrigerator is an apparatus for cooling a plurality of storage chambers, such as freezing chambers and refrigerating chambers, by employing freezing cycle devices of a compressor, a condenser, an expansion mechanism, and an evaporator.

The refrigerator can cool the freezing chamber and the refrigerating chamber at the same time using one evaporator and also cool the freezing chamber and the refrigerating chamber independently using a freezing chamber evaporator for cooling the freezing chamber and a refrigerating chamber evaporator for cooling the refrigerating chamber.

Meanwhile, the above refrigerator performs defrost control for defrosting the evaporators. At the initial start-up of the compressor, when the operation integration time of the compressor is a specific time, for example, 4 hours, the defrost operation can be performed, or at the time of a general cooling operation, when the operation integration time of the compressor is a specific time, for example, 7 hours, the defrost operation can be performed.

However, defrost control of the conventional refrigerator is suitable for a refrigerator for cooling the freezing chamber and the refrigerating chamber at the same time using one evaporator. If typical defrost control is applied to a refrigerator in which the freezing chamber evaporator and the refrigerating chamber evaporator are independently installed, problems arise because even an evaporator that has not been frosted, of the freezing chamber evaporator and the refrigerating chamber evaporator, can be defrosted and even both the freezing chamber evaporator and the refrigerating chamber evaporator, which have not been frosted, can be defrosted.

DISCLOSURE OF INVENTION

Technical Problem

Accordingly, the present invention has been made keeping in mind the above problems occurring in the prior art, and an object of the present invention is to provide a method of controlling a refrigerator, in which, in the refrigerator including a plurality of evaporators for computing a plurality of storage chambers and being adapted to control refrigerant introduced into the plurality of evaporators using a refrigerant control valve, defrosting is carried out on the basis of an opening integration time of the refrigerant control valve, so that the respective evaporators can be defrosted at an exact point of time at which defrosting is substantially required.

Another object of the present invention is to provide a method of controlling a refrigerator, which can prevent a temperature within the refrigerator from rising excessively due to an excessive operation of a heater by differentiating defrost end determinations depending on ambient temperatures.

Technical Solution

In order to accomplish the above objects, the present invention provides a method of controlling a refrigerator, including a main body having a plurality of storage chambers; a plurality of evaporators installed to independently cool the plurality of storage chambers, respectively; and a refrigerant control valve for controlling refrigerant introduced into the plurality of evaporators, the method including a refrigerant control valve opening step of opening the refrigerant control valve so that the refrigerant can be introduced into at least one of the plurality of evaporators; an evaporator defrost step of, when an opening integration time of the refrigerant control valve is higher than a defrost setting time of the evaporator, at which the refrigerant is introduced by the refrigerant control valve, operating the refrigerator in a defrost mode of the evaporator in which the refrigerant is introduced; and an evaporator defrost end step of, when a temperature sensed by a defrost sensor of the evaporator that is being defrosted is higher than a return setting temperature after the evaporator defrost step begins, finishing the defrost mode of the refrigerator.

The plurality of storage chambers comprises a freezing chamber and a refrigerating chamber, the plurality of evaporators comprises a freezing chamber evaporator and a refrigerating chamber evaporator, the defrost sensor comprises a freezing defrost sensor and a refrigerating defrost sensor, and the defrost setting time and the return setting temperature are set every freezing chamber evaporator and every refrigerating chamber evaporator, respectively.

The evaporator defrost step includes turning off a compressor and turning on a freezing defrost heater installed to defrost the freezing chamber evaporator, when an opening integration time of the freezing chamber evaporator of the refrigerant control valve is higher than a freezing defrost setting time, and the evaporator defrost end step includes turning off the freezing defrost heater.

One freezing return setting temperature set according to an ambient temperature, of a plurality of freezing return setting temperatures, is compared with a temperature sensed by the freezing defrost sensor.

If, after the evaporator defrost step begins, a temperature sensed by the freezing defrost sensor does not become higher than a freezing return setting temperature within a freezing defrost delay time, the evaporator defrost step is forcibly finished.

When the evaporator defrost step is forcibly finished, defrost error is displayed.

The evaporator defrost step includes turning off a compressor and turning on a refrigerating defrost heater installed to defrost the refrigerating chamber evaporator when an opening integration time of the freezing chamber evaporator of the refrigerant control valve is less than a freezing defrost setting time and an opening integration time of the refrigerating chamber evaporator of the refrigerant control valve is higher than a refrigerating defrost setting time, and the evaporator defrost end step includes turning off the refrigerating defrost heater.

One refrigerating return setting temperature set according to an ambient temperature, of a plurality of refrigerating return setting temperatures, is compared with a temperature sensed by the refrigerating defrost sensor.

If, after the evaporator defrost step begins, a temperature sensed by the refrigerating defrost sensor does not become higher than a refrigerating return setting temperature within a refrigerating defrost delay time, the evaporator defrost step is forcibly finished.

When the evaporator defrost step is forcibly finished, defrost error is displayed.

Further, the present invention provides a method of controlling a refrigerator, including a main body having a freezing chamber and a refrigerating chamber; a freezing chamber evaporator installed to cool the freezing chamber; a refrigerating chamber evaporator installed to cool the refrigerating chamber; and a refrigerant control valve for controlling refrigerant introduced into the freezing chamber evaporator and the refrigerating chamber evaporator, the method including a refrigerant control valve opening step of opening the refrigerant control valve so that the refrigerant can be introduced into at least one of the freezing chamber evaporator and the refrigerating chamber evaporator; a freezing chamber evaporator defrost step of, when a freezing chamber evaporator opening integration time of the refrigerant control valve is higher than a freezing defrost setting time, operating the refrigerator in a freezing chamber evaporator defrost mode; and a freezing chamber evaporator defrost end step of, when a temperature sensed by a freezing defrost sensor is higher than a freezing return setting temperature after the refrigerator begins operating in the freezing chamber evaporator defrost mode, finishing the freezing chamber evaporator defrost mode of the refrigerator.

The freezing chamber evaporator defrost step includes turning off a compressor and turning on a freezing defrost heater for defrosting the freezing chamber evaporator, and the freezing chamber evaporator defrost end step includes turning off the freezing defrost heater.

One freezing return setting temperature set according to an ambient temperature, of a plurality of freezing return setting temperatures, is compared with a temperature sensed by the freezing defrost sensor.

If, after the refrigerator begins operating in the freezing chamber evaporator defrost mode, the temperature sensed by the freezing defrost sensor does not become higher than the freezing return setting temperature within a freezing defrost delay time, the freezing chamber evaporator defrost mode of the refrigerator is forcibly finished.

When the freezing chamber evaporator defrost mode is forcibly finished, defrost error is displayed.

The freezing chamber evaporator defrost step and the freezing chamber evaporator defrost end step are repeatedly performed, and when a next freezing chamber evaporator defrost step after the defrost error is displayed is performed, if the temperature sensed by the freezing defrost sensor becomes lower than the freezing return setting temperature within the freezing defrost delay time, the display of the defrost error is stopped.

Further, the present invention provides a method of controlling a refrigerator, including a main body having a freezing chamber and a refrigerating chamber; a freezing chamber evaporator installed to cool the freezing chamber; a refrigerating chamber evaporator installed to cool the refrigerating chamber; and a refrigerant control valve for controlling refrigerant introduced into the freezing chamber evaporator and the refrigerating chamber evaporator, the method including a refrigerant control valve opening step of opening the refrigerant control valve so that the refrigerant can be introduced into at least one of the freezing chamber evaporator and the refrigerating chamber evaporator; a freezing chamber evaporator defrost step of, when a freezing chamber evaporator opening integration time of the refrigerant control valve is higher than a freezing defrost setting time, operating the refrigerator in a freezing chamber evaporator defrost mode; and a freezing chamber evaporator defrost end step of, when a temperature sensed by a freezing defrost sensor is higher than a freezing return setting temperature after the refrigerator begins operating in the freezing chamber evaporator defrost mode, finishing the freezing chamber evaporator defrost mode of the refrigerator.

The freezing chamber evaporator defrost step includes turning off a compressor and turning on a freezing defrost heater for defrosting the freezing chamber evaporator, and the freezing chamber evaporator defrost end step includes turning off the freezing defrost heater.

One freezing return setting temperature set according to an ambient temperature, of a plurality of freezing return setting temperatures, is compared with a temperature sensed by the freezing defrost sensor.

If, after the refrigerator begins operating in the freezing chamber evaporator defrost mode, the temperature sensed by the freezing defrost sensor does not become higher than the freezing return setting temperature within a freezing defrost delay time, the freezing chamber evaporator defrost mode of the refrigerator is forcibly finished.

When the freezing chamber evaporator defrost mode is forcibly finished, defrost error is displayed.

The refrigerant control valve opening step, the freezing chamber evaporator defrost step, and the freezing chamber evaporator defrost end step are repeatedly performed, and when a next freezing chamber evaporator defrost step after the defrost error is displayed is performed, if the temperature sensed by the freezing defrost sensor becomes lower than the freezing return setting temperature within the freezing defrost delay time, the display of the defrost error is stopped.

Advantageous Effects

In the method of controlling the refrigerator constructed as above in accordance with the present invention, whether the freezing chamber evaporator has been frosted is determined on the basis of the freezing opening integration time of the refrigerant control valve for controlling refrigerant introduced into the freezing chamber evaporator. Accordingly, there is an advantage in that the freezing chamber evaporator can be defrosted at an exact point of time at which defrosting of the freezing chamber evaporator is required.

Further, in the method of controlling the refrigerator according to the present invention, a freezing return temperature is set differently depending on an outside temperature and, therefore, defrost end times are different. Accordingly, there are advantages in that a temperature within the refrigerator can be prevented from rising unnecessarily due to excessive turn-on of the freezing defrost heater, a temperature change within the refrigerator can be minimized, and the cycle cooling performance can be improved.

In the method of controlling the refrigerator constructed as above in accordance with the present invention, whether the refrigerating chamber evaporator has been frosted is determined on the basis of the refrigerating opening integration time of the refrigerant control valve for controlling refrigerant introduced into the refrigerating chamber evaporator. Accordingly, there is an advantage in that the refrigerating chamber evaporator can be defrosted at an exact point of time at which defrosting of the refrigerating chamber evaporator is required.

Further, in the method of controlling the refrigerator according to the present invention, a refrigerating return temperature is set differently depending on an outside temperature and, therefore, defrost end times are different. Accordingly, there are advantages in that a temperature within the refrigerator can be prevented from rising unnecessarily due to excessive turn-on of the refrigerating defrost heater, a temperature change within the refrigerator can be minimized, and the cycle cooling performance can be improved.

BEST MODE FOR CARRYING OUT THE INVENTION

Figure 1:
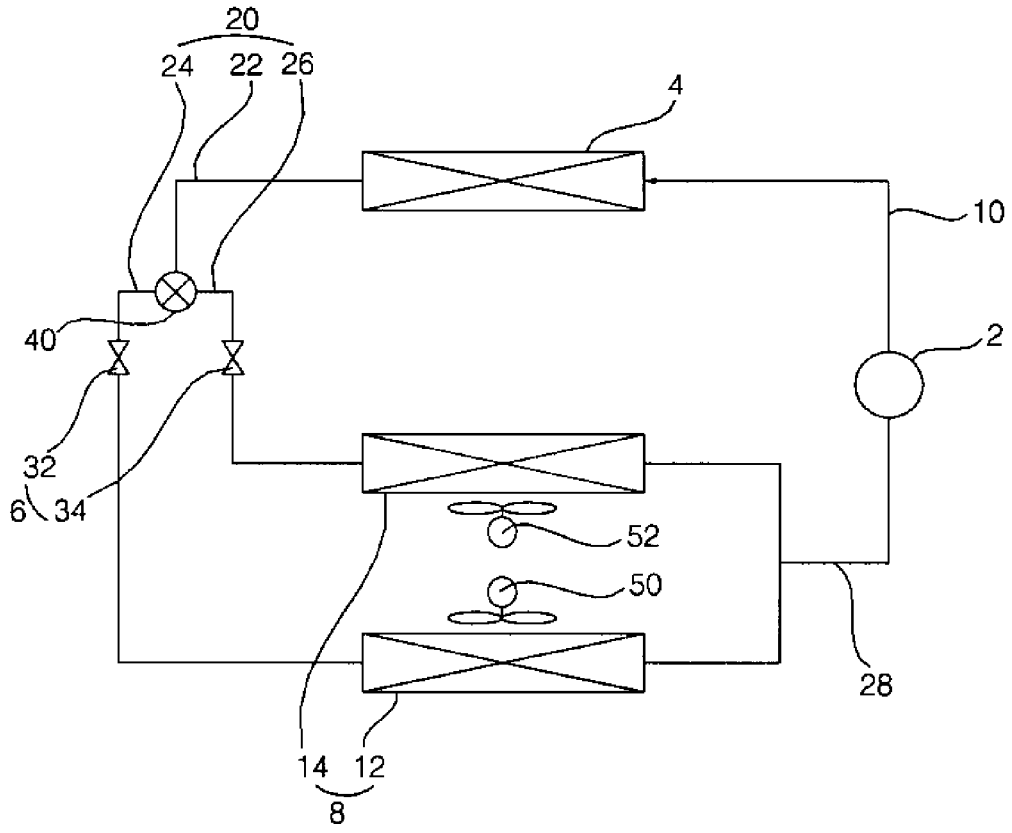
FIG. 1 is a schematic view of a refrigerator to which an embodiment of a method of controlling a refrigerator in accordance with the present invention is applied.
Figure 2:
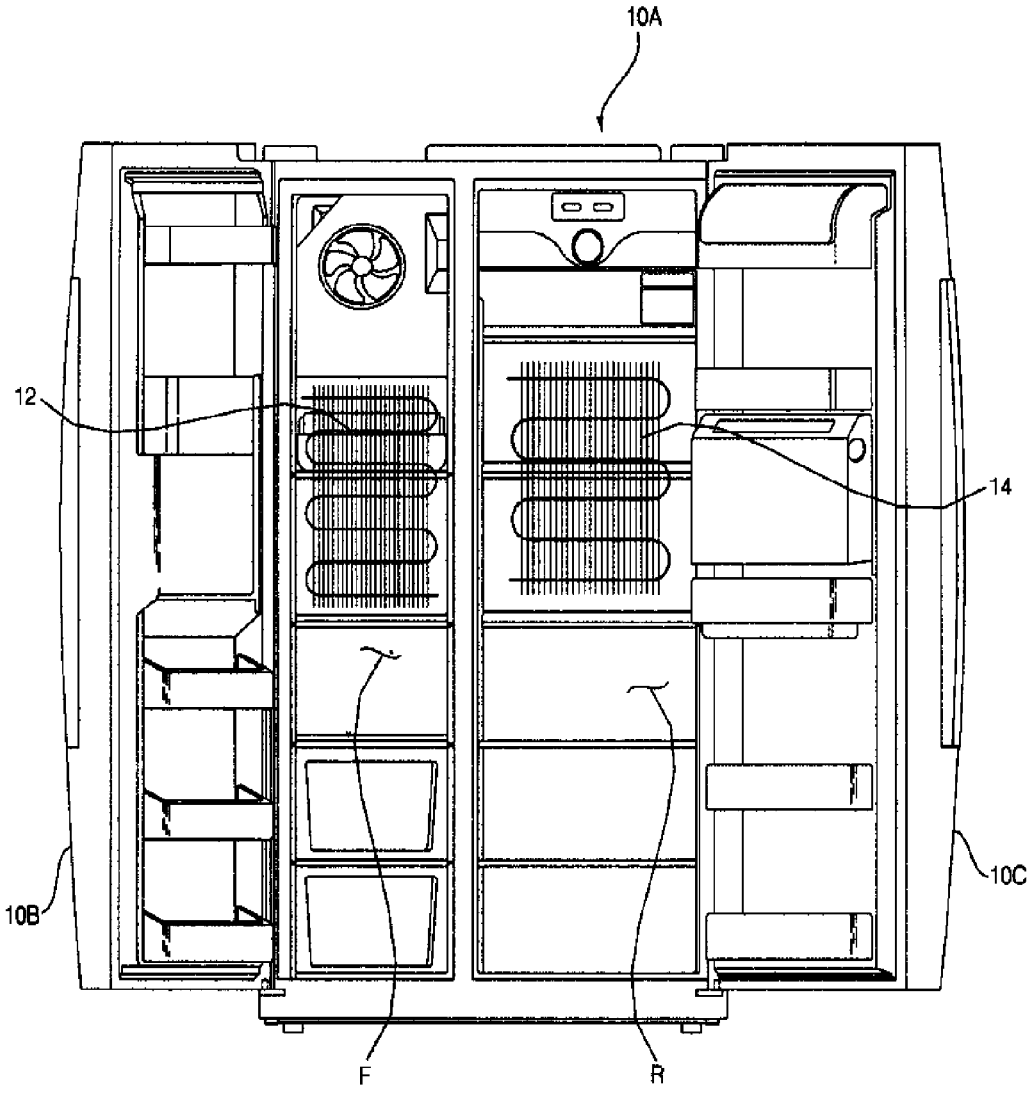
FIG. 2 is a front view showing that the inside of the refrigerator to which an embodiment of the method of controlling the refrigerator in accordance with the present invention is applied is opened.
Figure 3:
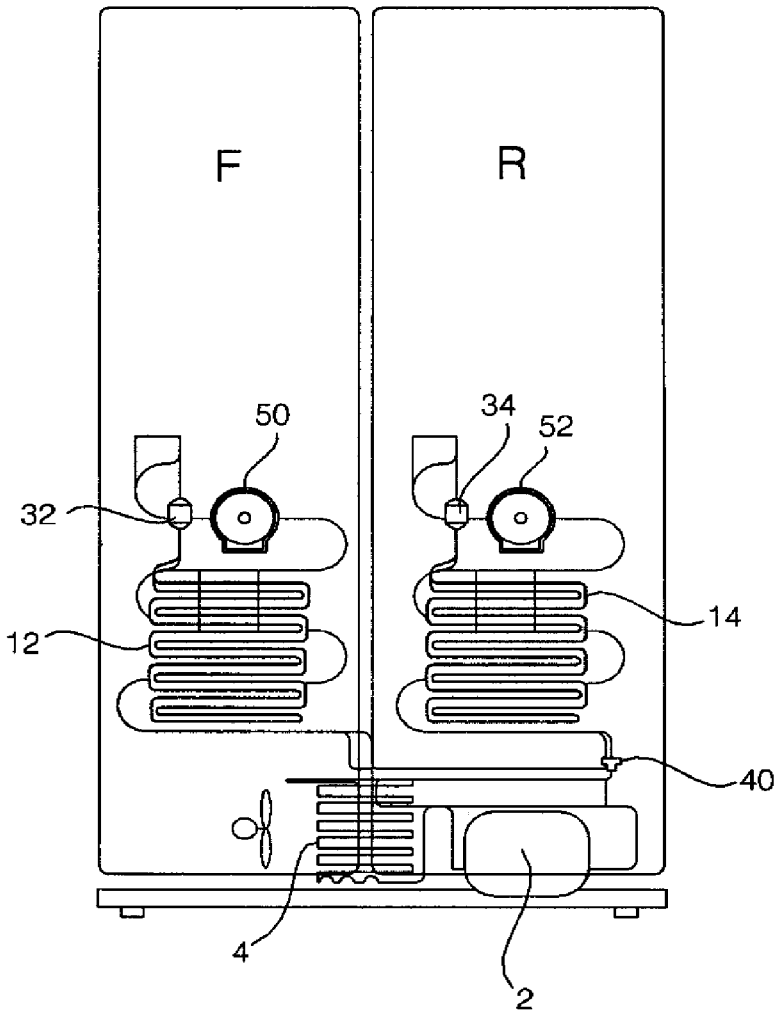
FIG. 3 is an internal construction of the refrigerator to which an embodiment of the method of controlling the refrigerator in accordance with the present invention is applied.

FIG. 1 is a schematic view of a refrigerator to which an embodiment of a method of controlling the refrigerator in accordance with the present invention is applied. FIG. 2 is a front view showing that the inside of the refrigerator to which an embodiment of the method of controlling the refrigerator in accordance with the present invention is applied is opened. FIG. 3 is an internal construction of the refrigerator to which an embodiment of the method of controlling the refrigerator in accordance with the present invention is applied.

The refrigerator shown in FIGS. 1 to 3 includes a compressor 2 for compressing refrigerant, a condenser 4 for condensing the refrigerant compressed in the compressor 2, an expansion mechanism 6 for expanding the refrigerant condensed in the condenser 4, and an evaporator 8 for evaporating the refrigerant expanded in the expansion mechanism 6. The compressor 2, the condenser 4, the expansion mechanism 6, and the evaporator 8 are connected through a refrigerant pipeline 10.

The refrigerator includes a main body 10A and doors 10B and 10C for opening and shutting the storage chambers. The main body 10A is provided with a plurality of storage chambers for storing food and drink, etc. The refrigerator includes a plurality of evaporators for independently cooling the respective storage chambers. Hereinafter, it is described that the storage chambers is constructed of a freezing chamber F and a refrigerating chamber R, and the plurality of evaporators is constructed of a freezing chamber evaporator 12 for cooling the freezing chamber F and a refrigerating chamber evaporator 14 for cooling the refrigerating chamber R in order to independently cool the freezing chamber F and the refrigerating chamber R.

The evaporator 8 can include the freezing chamber evaporator 12 and the refrigerating chamber evaporator 14, which are connected in series or in parallel. However, it is assumed that, for efficient independent cooling of the freezing chamber F and the refrigerating chamber R, the freezing chamber evaporator 12 and the refrigerating chamber evaporator 14 are connected in parallel.

That is, a refrigerant pipeline 20 between the evaporator 8 and the condenser 4, of the refrigerant pipeline 10, includes a condenser connecting pipeline 22 coupled to the condenser 4, a freezing chamber evaporator connecting pipeline 24 coupled to the freezing chamber evaporator 12, and a refrigerating chamber evaporator connecting pipeline 26 coupled to the refrigerating chamber evaporator 14.

Further, the expansion mechanism 6 has one expansion mechanism installed in the condenser connecting pipeline 22, so that refrigerant expanded in one expansion mechanism can be supplied to at least one of the freezing chamber evaporator 12 and the refrigerating chamber evaporator 14. An expansion mechanism 32 for the freezing chamber is installed in the freezing chamber evaporator connecting pipeline 24, so that refrigerant introduced into the freezing chamber evaporator 12 can be expanded. Further, an expansion mechanism 34 for the refrigerating chamber is installed in the refrigerating chamber evaporator connecting pipeline 26, so that refrigerant introduced into the refrigerating chamber evaporator 14 can be expanded. Hereinafter, it is described that the expansion mechanism 32 for the freezing chamber and the expansion mechanism 34 for the refrigerating chamber are respectively provided.

Meanwhile, the refrigerator includes a refrigerant control valve 40 for controlling refrigerant introduced into the freezing chamber evaporator 12 and the refrigerating chamber evaporator 14. The refrigerant control valve 40 can include a valve for the freezing chamber evaporator, which is installed in the freezing chamber evaporator connecting pipeline 24 and controls refrigerant introduced into the freezing chamber evaporator 12, and a valve for the refrigerating chamber evaporator, which is installed in the refrigerating chamber evaporator connecting pipeline 26 and controls refrigerant introduced into the refrigerating chamber evaporator 14. The refrigerant control valve 40 can also include one three-way valve installed at a point where the freezing chamber evaporator connecting pipeline 24 and the refrigerating chamber evaporator connecting pipeline 26 are divided at the condenser connecting pipeline 22 and adapted to control refrigerant introduced into the freezing chamber evaporator 12 and refrigerant introduced into the refrigerating chamber evaporator 14 at the same time. It is most preferred that the refrigerant control valve 40 includes one three-way valve when considering the number of components, an assembly process and so on. Hereinafter, it is described that the condenser connecting pipeline 22, the evaporator connecting pipeline 24, and the refrigerating chamber evaporator connecting pipeline 26 are all coupled to one refrigerant control valve 40, that is, a three-way valve.

Meanwhile, the refrigerator further includes a freezing chamber fan 50 for circulating the air of the freezing chamber F through the freezing chamber evaporator 12, and a refrigerating chamber fan 52 for circulating the air of the refrigerating chamber R through the refrigerating chamber evaporator 14.

In other words, the refrigerator in accordance with the present embodiment employs a 1COMP-2EVA system in which one compressor 2, the two evaporators 12 and 14, and the two fans 50 and 52 are provided and the freezing chamber F and the refrigerating chamber R are cooled independently.

Figure 4:
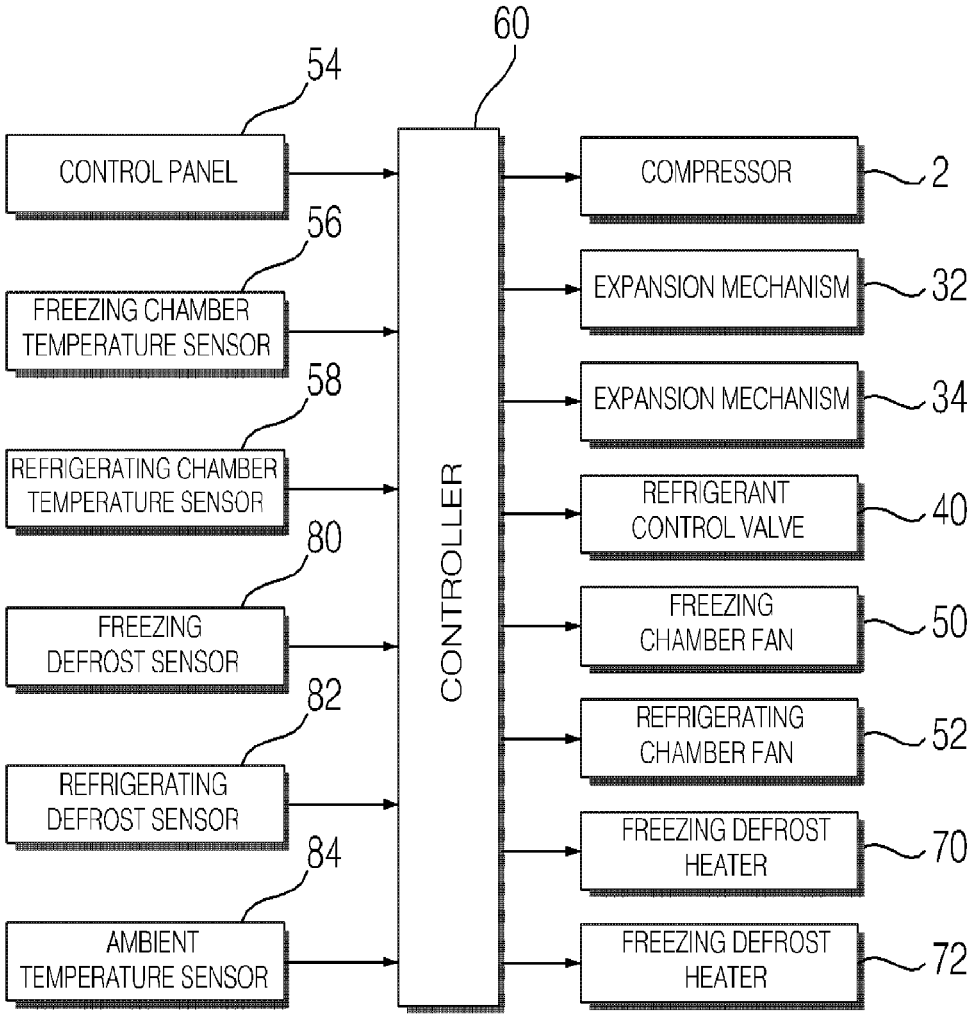
FIG. 4 is a control block diagram of the refrigerator to which an embodiment of the method of controlling the refrigerator in accordance with the present invention is applied.

FIG. 4 is a control block diagram of the refrigerator to which an embodiment of the method of controlling the refrigerator in accordance with the present invention is applied.

The refrigerator in accordance with the present embodiment further includes, as shown in FIG. 4, a controller 60 for controlling the compressor 2, the refrigerant control valve 40, the freezing chamber fan 50, the refrigerating chamber fan 52, etc. depending on the input by a user, the load of the freezing chamber F, the load of the refrigerating chamber R, and so on.

That is, the refrigerator further includes a control panel 54 for enabling a user to input an operation command of the refrigerator, a freezing chamber temperature sensor 56 for sensing a temperature of the freezing chamber F, and a refrigerating chamber temperature sensor 58 for sensing a temperature of the refrigerating chamber R. The controller 60 controls the compressor 2, the expansion mechanism 32 for the freezing chamber, the expansion mechanism 34 for the refrigerating chamber, the refrigerant control valve 40, the freezing chamber fan 50, the refrigerating chamber fan 52 and the like depending on a user s input to the control panel 54, a temperature of the freezing chamber F, a temperature of the refrigerating chamber R, and so on.

Meanwhile, the controller 60 determines whether the freezing chamber evaporator 12 has been frosted in order to operate a defrost mechanism of the freezing chamber evaporator and determines whether the refrigerating chamber evaporator 14 has been frosted in order to operate a defrost mechanism of a refrigerating chamber evaporator.

Here, the defrost mechanism of the freezing chamber evaporator may comprise a freezing bypass flow passage for bypassing refrigerant and a freezing bypass valve installed in the freezing bypass flow passage so that gaseous refrigerant of a high temperature and high pressure, which is compressed in the compressor 2, can be supplied to the freezing chamber evaporator 12. The defrost mechanism of the freezing chamber evaporator may also comprise a freezing defrost heater 70 for directly heating the freezing chamber evaporator 12. Hereinafter, it is described that the defrost mechanism of the freezing chamber evaporator comprises the freezing defrost heater 70, for convenience of description.

Further, the defrost mechanism of the refrigerating chamber evaporator may comprise a refrigerating bypass flow passage for bypassing refrigerant and a refrigerating bypass valve installed in the refrigerating bypass flow passage so that gaseous refrigerant of a high temperature and high pressure, which is compressed in the compressor 2, can be supplied to the refrigerating chamber evaporator 14. The defrost mechanism of the refrigerating chamber evaporator may also comprise a refrigerating defrost heater 72 for directly heating the refrigerating chamber evaporator 14. Hereinafter, it is described that the defrost mechanism of the refrigerating chamber evaporator comprises the refrigerating defrost heater 72, for convenience of description.

The defrosting of the freezing chamber evaporator 12 and the defrosting of the refrigerating chamber evaporator 14 under the control of the controller 60 are described in detail below.

The controller 60 determines whether the freezing chamber evaporator 12 has been frosted. If, as a result of the determination, defrosting is needed for the freezing chamber evaporator 12, the controller 60 turns on the freezing defrost heater 70. After the freezing defrost heater 70 is turned on, the controller 60 determines whether the defrosting of the freezing chamber evaporator 12 has been completed. If, as a result of the determination, the defrosting of the freezing chamber evaporator 12 has to be completed, the controller 60 turns off the freezing defrost heater 70.

Here, the controller 60 determines whether an evaporator has been frosted in consideration of the time when the refrigerant control valve 40 has supplied refrigerant to the freezing chamber evaporator 12 and determines whether defrosting has been completed in consideration of a temperature of the freezing chamber evaporator 12.

The controller 60 also determines whether the refrigerating chamber evaporator 14 has been frosted. If, as a result of the determination, the refrigerating chamber evaporator 14 should be defrosted, the controller 60 turns on the refrigerating defrost heater 72. After the refrigerating defrost heater 72 is turned on, the controller 60 determines whether the refrigerating chamber evaporator 14 has been defrosted. If, as a result of the determination, the defrosting of the refrigerating chamber evaporator 14 has to be completed, the controller 60 turns off the refrigerating defrost heater 72.

The controller 60 determines whether an evaporator has been frosted in consideration of the time when the refrigerant control valve 40 has supplied refrigerant to the refrigerating chamber evaporator 14 and determines whether defrosting has been completed in consideration of a temperature of the refrigerating chamber evaporator 14.

The refrigerator further includes a freezing defrost sensor 80 for sensing a temperature of the freezing chamber evaporator 12 in order to determine whether defrosting of the freezing chamber evaporator 12 has been completed, and a refrigerating defrost sensor 82 for sensing a temperature of the refrigerating chamber evaporator 14 in order to determine whether defrosting of the refrigerating chamber evaporator 14 has been completed.

In the refrigerator in accordance with the present embodiment, a freezing return setting temperature and a refrigerating return setting temperature are set differently depending on external load, that is, ambient temperatures of the refrigerator. The refrigerator in accordance with the present embodiment further includes an ambient temperature sensor 84 for sensing ambient temperatures of the refrigerator. The controller 60 sets a freezing return setting temperature and a refrigerating return setting temperature according to an ambient temperature sensed by the ambient temperature sensor 84.

Figure 5:
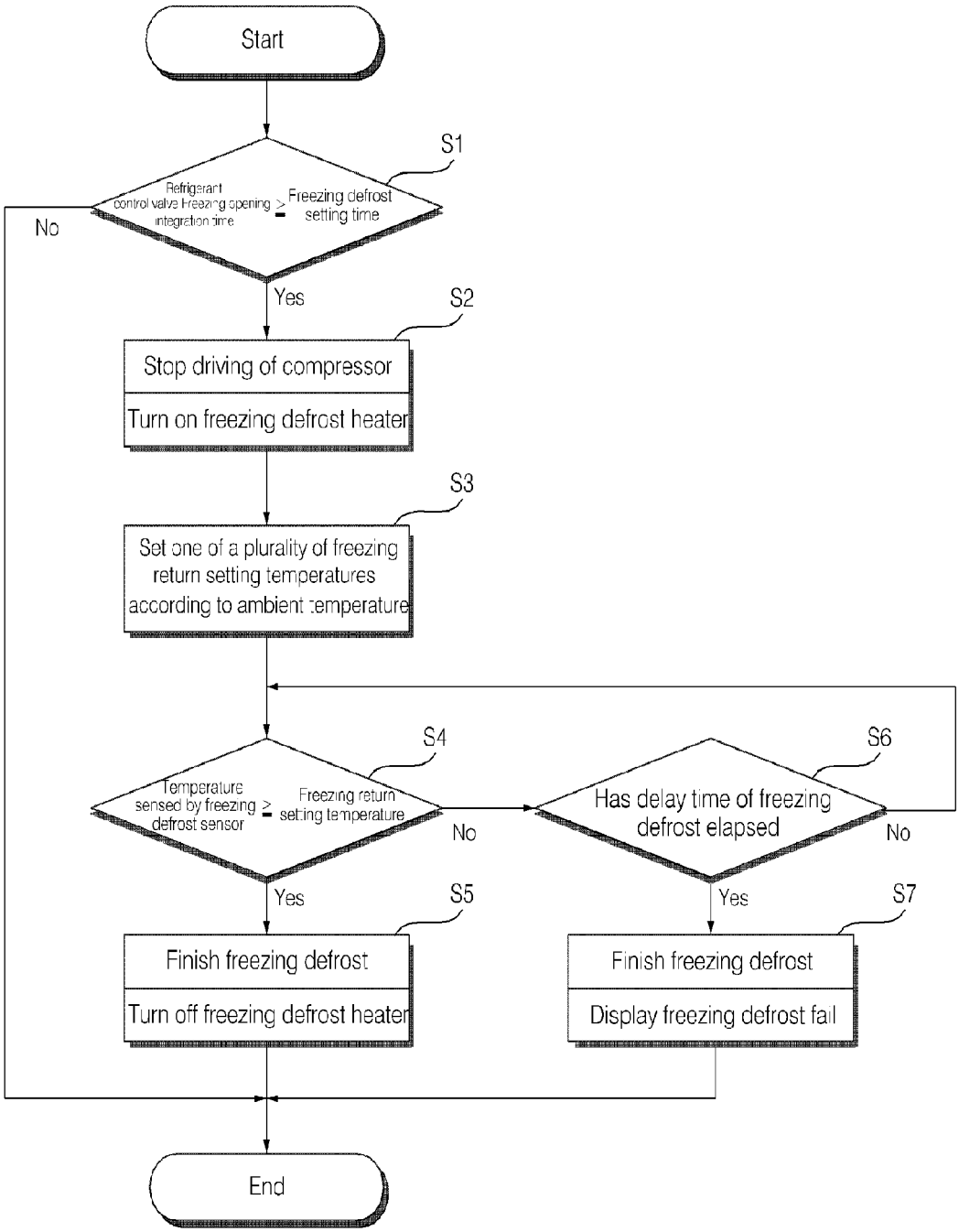
FIG. 5 is a flowchart to which an embodiment of the method of controlling the refrigerator in accordance with the present invention is applied.

FIG. 5 is a flowchart to which an embodiment of the method of controlling the refrigerator in accordance with the present invention is applied.

The method of controlling a refrigerator in accordance with the present embodiment includes a cooling step at least one of the freezing chamber F and the refrigerating chamber R.

In the cooling step (S1), simultaneous cooling in which the freezing chamber F and the refrigerating chamber R are cooled at the same time is possible, and independent cooling in which only any one of the freezing chamber F and the refrigerating chamber R is cooled is possible.

In the case of simultaneous cooling of the freezing chamber F and the refrigerating chamber R, the controller 60 drives the compressor 2, controls the refrigerant control valve 40 in a simultaneous supply mode, and rotates both the freezing chamber fan 50 and the refrigerating chamber fan 52.

Meanwhile, in the case of independent cooling of the freezing chamber F, the controller 60 drives the compressor 2, controls the refrigerant control valve 40 in a freezing chamber evaporator opening mode, and rotates the freezing chamber fan 50. In the case of independent cooling of the refrigerating chamber R, the controller 60 drives the compressor 2, controls the refrigerant control valve 40 in a refrigerating chamber evaporator opening mode, and rotates the refrigerating chamber fan 52.

During this simultaneous cooling or independent cooling, the controller 60 determines whether the freezing chamber evaporator 12 has been frosted on the basis of a freezing chamber evaporator opening integration time of the refrigerant control valve 60 and determines whether the refrigerating chamber evaporator 14 has been frosted on the basis of a refrigerating chamber evaporator opening integration time of the refrigerant control valve 60.

Here, in the case in which the freezing chamber evaporator 12 has been frosted and the refrigerating chamber evaporator 14 has not been frosted, the controller 60 performs defrosting of the freezing chamber evaporator 12. In the case in which the refrigerating chamber evaporator 14 has been frosted and the freezing chamber evaporator 12 has not been frosted, the controller 60 performs defrosting of the refrigerating chamber evaporator 14. In the case in which both the refrigerating chamber evaporator 14 and the freezing chamber evaporator 12 have been frosted, the controller 60 can perform defrosting of the freezing chamber evaporator 12 and the refrigerating chamber evaporator 14 at the same time, or perform defrosting of one (12) of the two evaporators 12 and then perform defrosting of the other (14) of the two evaporators.

Further, the controller 60 can first determine whether the freezing chamber evaporator 12 has been frosted. If, as a result of the determination, the freezing chamber evaporator 12 has been frosted, the controller 60 can first perform defrosting of the freezing chamber evaporator 12 irrespective of whether the refrigerating chamber evaporator 14 has been frosted. If, as a result of the determination, the freezing chamber evaporator 12 has not been frosted, the controller 60 can perform whether the refrigerating chamber evaporator 14 has been frosted and defrost the refrigerating chamber evaporator 14 according to the determination result. Frosting and defrosting of the refrigerating chamber evaporator 14 are described in detail later on. First, frosting and defrosting of the freezing chamber evaporator 12 are described in detail below.

First, when the freezing chamber evaporator opening integration time of the refrigerant control valve 40 is greater than a freezing defrost setting time, it is meant that refrigerant has been supplied to the freezing chamber evaporator 12 during the freezing chamber evaporator opening integration time. Therefore, the controller 60 determines that the freezing chamber evaporator 12 has been frosted and performs freezing chamber evaporator defrost steps (S1, S2) in which the refrigerator is operated in the freezing chamber evaporator defrost mode.

Here, the freezing defrost setting time is a reference time for determining whether the freezing chamber evaporator 12 has been frosted. The freezing defrost setting time is set differently at the time of first one-time frosting determination, which is performed after the refrigerator is powered on, and subsequent general frosting determination. A freezing defrost setting time P1 at the time of first one-time frosting determination is set to be shorter than a freezing defrost setting time P2 at the time of general frosting determination.

At the time of first one-time frosting determination, the controller 60 compares the freezing chamber evaporator opening integration time of the refrigerant control valve 40 with the freezing defrost setting time P1 at the time of first one-time frosting determination and determines whether the freezing chamber evaporator 12 has been frosted. At the time of general frosting determination, the controller 60 compares the freezing chamber evaporator opening integration time of the refrigerant control valve 40 with the freezing defrost setting time P2 at the time of general frosting determination and determines whether the freezing chamber evaporator 12 has been frosted.

In other words, defrosting of the freezing chamber evaporator 12, which is performed for the first time after the refrigerator is powered on, begins relatively earlier than defrosting of the freezing chamber evaporator 12, which is performed subsequently. Thus, the first frosting after power-on can be defrosted rapidly.

Meanwhile, in the freezing chamber evaporator defrost mode, the controller 60 stops the driving of the compressor 2 and the freezing chamber fan 50 and turns on the freezing defrost heater 70 (S2).

In the refrigerator, when the compressor 2 stops driving, refrigerant does not circulate through the compressor 2, the condenser 4, the refrigerant control valve 40, the expansion mechanism 32 for the freezing chamber, and the freezing chamber evaporator 12, and the freezing chamber evaporator 12 begins defrosting by heat of the freezing defrost heater 70.

Further, the controller 60 sets the freezing return setting temperature, that is, a reference temperature for determining whether defrosting has been completed. The controller 60 selects one of a plurality of freezing return setting temperatures T1 and T2, which is set according to an ambient temperature (S3).

Typically, an ambient temperature of a refrigerator is set in the range of 15 to 35 degrees Celsius. At this time, the freezing return setting temperature T1 higher than an ambient temperature is set to be higher than the freezing return setting temperature T2 less than an ambient temperature.

In other words, when external load is great, the freezing return setting temperature is set to be high so that the freezing chamber evaporator 12 can be defrosted sufficiently. When external load is small, the freezing return setting temperature is set to be low in order to prevent a temperature within the refrigerator from rising unnecessarily. Accordingly, a change in the temperature within the refrigerator can be minimized and a cycle cooling performance can be improved.

At this time, it is preferred that a temperature difference between the freezing return setting temperature T1 higher than an ambient temperature and the freezing return setting temperature T2 less than an ambient temperature be set not to be great, most preferably, in the range of 2 to 7 degrees Celsius.

Meanwhile, after the refrigerator operates in the freezing chamber evaporator defrost mode, that is, while the freezing chamber evaporator 12 is being defrosted, the controller 60 compares a temperature sensed by the freezing defrost sensor 80 and a freezing return setting temperature set according to an ambient temperature (S4).

If, as a result of the comparison, the temperature sensed by the freezing defrost sensor 80 is higher than the freezing return setting temperature, the controller 60 performs a freezing chamber evaporator defrost end step of finishing the freezing chamber evaporator defrost mode of the refrigerator (S5).

That is, the controller 60 turns off the freezing defrost heater 70.

Meanwhile, if, after the refrigerator starts operating in the freezing chamber evaporator defrost mode, the temperature sensed by the freezing defrost sensor 80 does not rise higher than the freezing return setting temperature within a freezing defrost delay time D1, the controller 60 determines that the defrosting of the freezing chamber evaporator 12 is fail and finishes the freezing chamber evaporator defrost mode of the refrigerator. The controller 60 then displays defrost error on a display provided in the control panel 54 or informs defrost error through a sound unit such as a buzzer (S6, S7).

Here, the freezing defrost delay time D1 is a reference time for determining whether defrosting of the freezing chamber evaporator is fail. If a temperature sensed by the freezing defrost sensor 80 does not reach the freezing return setting temperature despite that the freezing defrost delay time D1 has elapsed, the controller 60 forcibly finishes the freezing chamber evaporator defrost mode of the refrigerator. In other words, the controller 60 turns off the freezing defrost heater 70.

Alternatively, after the above freezing chamber evaporator defrost end step, the refrigerator can perform the cooling step of the freezing chamber F depending on load of the freezing chamber, and so on and repeatedly perform the freezing chamber evaporator defrost step and the freezing chamber evaporator defrost end step as described above.

Meanwhile, when performing a next freezing chamber evaporator defrost step after the defrost error is displayed, if a temperature sensed by the freezing defrost sensor 80 becomes below the freezing return setting temperature within the freezing defrost delay time D1, the controller 60 determines that the freezing chamber evaporator 12 is defrosted smoothly in the freezing chamber evaporator defrost step and therefore stops the display of the defrost error.

Figure 6:
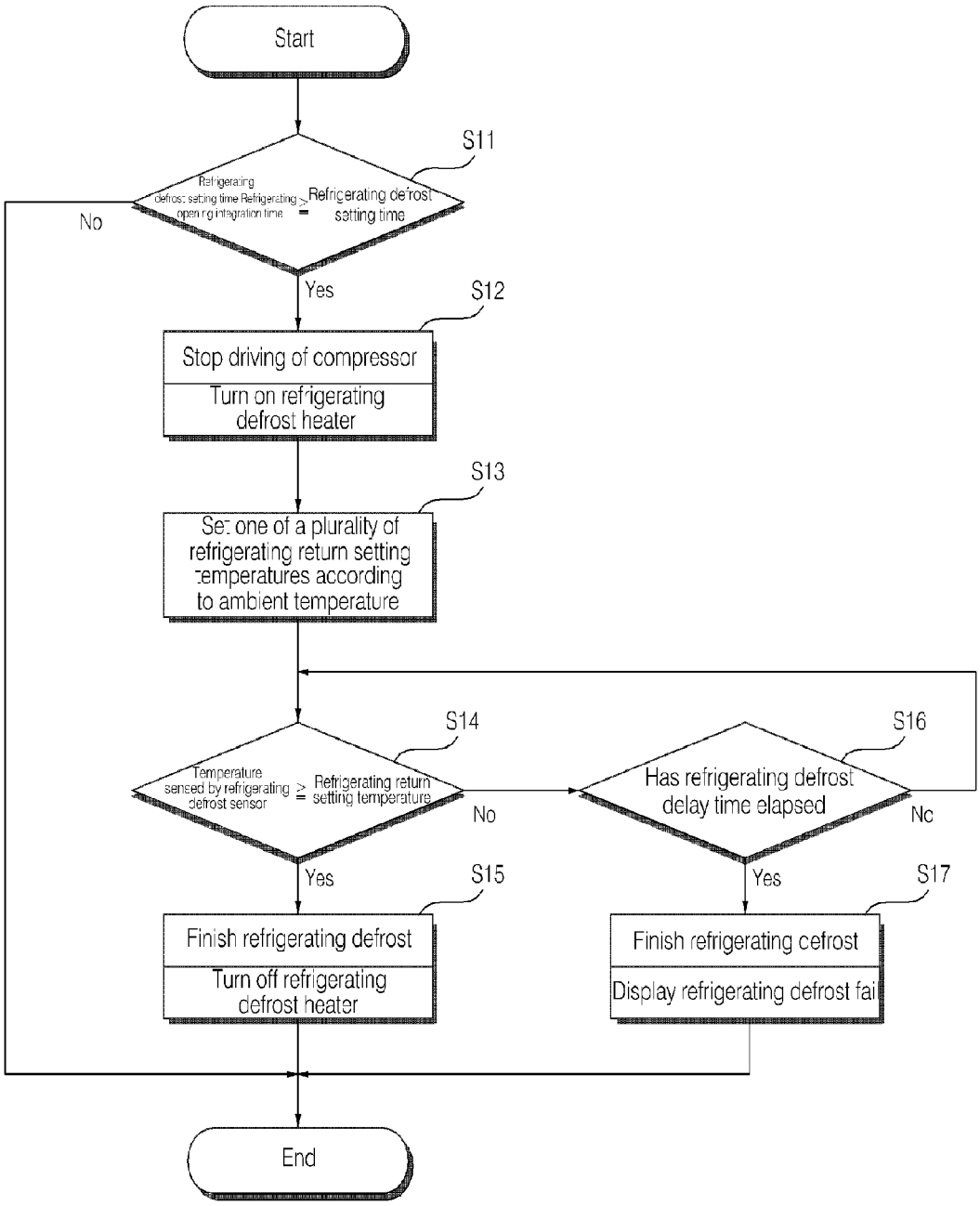
FIG. 6 is a flowchart to which another embodiment of a method of controlling the refrigerator in accordance with the present invention is applied.

FIG. 6 is a flowchart to which another embodiment of a method of controlling the refrigerator in accordance with the present invention is applied.

The method of controlling the refrigerator in accordance with the present embodiment includes a cooling step of cooling at least one of the freezing chamber F and the refrigerating chamber R. The cooling step is identical to the embodiment of the method of controlling a refrigerator in accordance with the present invention and detailed description thereof is omitted.

When the refrigerating chamber evaporator opening integration time of the refrigerant control valve 40 is greater than a refrigerating defrost setting time while the cooling step is being performed, it is meant that refrigerant has been supplied to the refrigerating chamber evaporator 14 during the refrigerating chamber evaporator opening integration time. Therefore, the controller 60 determines that the refrigerating chamber evaporator 14 has been frosted and performs refrigerating chamber evaporator defrost steps (S11, S12) in which the refrigerator is operated in the refrigerating chamber evaporator defrost mode.

Here, the controller 60 can determine whether the refrigerating chamber evaporator 14 has been frosted, irrespective of whether the freezing chamber evaporator 12 has been frosted or before determining whether the freezing chamber evaporator 12 has been frosted, and perform defrosting of the refrigerating chamber evaporator 14 according to the determination result. If the freezing chamber evaporator 12 has not been frosted, the controller 60 can determine whether the refrigerating chamber evaporator 14 has been frosted and perform defrosting of the refrigerating chamber evaporator 14 according to the determination result.

In the case in which, as a result of the determination, the freezing chamber evaporator 12 has not been frosted, but the refrigerating chamber evaporator 14 has been frosted, when the freezing chamber evaporator opening integration time of the refrigerant control valve 40 is less than a freezing defrost setting time and the refrigerating chamber evaporator opening integration time of the refrigerant control valve 40 is greater than a refrigerating defrost setting time while the cooling step is being performed, the controller 60 determines that the refrigerating chamber evaporator 14 has been frosted and performs defrosting of the refrigerating chamber evaporator 14 according to the determination result.

Here, the refrigerating defrost setting time is a reference time for determining whether the refrigerating chamber evaporator 14 has been frosted. The refrigerating defrost setting time is set differently at the time of first one-time frosting determination, which is performed after the refrigerator is powered on, and subsequent general frosting determination. A refrigerating defrost setting time P3 at the time of first one-time frosting determination is set to be shorter than a freezing defrost setting time P4 at the time of general frosting determination.

At the time of first one-time frosting determination, the controller 60 compares a consecutive operation time of the refrigerating chamber fan 52 with the refrigerating defrost setting time P3 at the time of first one-time frosting determination and determines whether the refrigerating chamber evaporator 14 has been frosted. At the time of general frosting determination, the controller 60 compares a consecutive operation time of the refrigerating chamber fan 52 with the refrigerating defrost setting time P4 at the time of general frosting determination and determines whether the refrigerating chamber evaporator 14 has been frosted.

In other words, defrosting of the refrigerating chamber evaporator 14, which is performed for the first time after the refrigerator is powered on, begins relatively earlier than defrosting of the refrigerating chamber evaporator 14, which is performed subsequently. Thus, the first frosting after power-on can be defrosted rapidly.

Meanwhile, the refrigerating defrost setting time P3 at the time of first one-time frosting determination is set to be longer than the freezing defrost setting time P1 at the time of the first one-time frosting determination, and the refrigerating defrost setting time P4 at the time of general frosting determination is set to be longer than the freezing defrost setting time P2 at the time of the general frosting determination.

In the refrigerating chamber evaporator defrost mode, that is, if it is determined that the refrigerating chamber evaporator 14 has been frosted, the controller 60 stops the driving of the compressor 2 and the refrigerating chamber fan 52 and turns on the refrigerating defrost heater 72 (S12).

In the refrigerator, when the compressor 2 stops driving, refrigerant does not circulate through the compressor 2, the condenser 4, the refrigerant control valve 40, the expansion mechanism 34 for the refrigerating chamber, and the refrigerating chamber evaporator 14, and the refrigerating chamber evaporator 14 begins defrosting by heat of the refrigerating defrost heater 72.

Next, the controller 60 sets the refrigerating return setting temperature, that is, a reference temperature for determining whether defrosting has been completed. The controller 60 selects one of a plurality of refrigerating return setting temperatures T3 and T4, which is set according to an ambient temperature (S13).

Typically, an ambient temperature of a refrigerator is set in the range of 15 to 35 degrees Celsius. At this time, the refrigerating return setting temperature T3 higher than an ambient temperature is set to be higher than the refrigerating return setting temperature T4 less than an ambient temperature.

In other words, when external load is great, the refrigerating return setting temperature is set to be high so that the refrigerating chamber evaporator 14 can be defrosted sufficiently. When external load is small, the refrigerating return setting temperature is set to be low in order to prevent a temperature within the refrigerator from rising unnecessarily. Accordingly, a change in the temperature within the refrigerator can be minimized and a cycle cooling performance can be improved.

At this time, it is preferred that a temperature difference between the refrigerating return setting temperature T3 higher than an ambient temperature and the refrigerating return setting temperature T4 less than an ambient temperature be set not to be great, most preferably, in the range of 2 to 7 degrees Celsius.

Meanwhile, after the refrigerator operates in the refrigerating chamber evaporator defrost mode, that is, while the refrigerating chamber evaporator 14 is being defrosted, the controller 60 compares a temperature sensed by the refrigerating defrost sensor 82 and a refrigerating return setting temperature set according to an ambient temperature (S14).

If, as a result of the comparison, the temperature sensed by the refrigerating defrost sensor 82 is higher than the refrigerating return setting temperature, the controller 60 performs a refrigerating chamber evaporator defrost end step of finishing the refrigerating chamber evaporator defrost mode of the refrigerator (S15).

That is, the controller 60 turns off the refrigerating defrost heater 72.

Meanwhile, if, after the refrigerator starts operating in the refrigerating chamber evaporator defrost mode, a temperature sensed by the refrigerating defrost sensor 82 does not rise higher than the refrigerating return setting temperature within a refrigerating defrost delay time D2, the controller 60 determines that the defrosting of the refrigerating chamber evaporator 14 is fail and forcibly finishes the refrigerating chamber evaporator defrost mode of the refrigerator. The controller 60 then displays defrost error on the display provided in the control panel 54 or informs defrost error through a sound unit such as a buzzer (S16, S17).

Here, the refrigerating defrost delay time D2 is a reference time for determining whether defrosting of the refrigerating chamber evaporator 14 is fail. If the temperature sensed by the refrigerating defrost sensor 82 does not reach the refrigerating return setting temperature despite that the refrigerating defrost delay time D2 has elapsed, the controller 60 forcibly finishes the refrigerating chamber evaporator defrost mode of the refrigerator. In other words, the controller 60 turns off the refrigerating defrost heater 72.

Alternatively, after the above refrigerating chamber evaporator defrost end step, the refrigerator can perform the cooling step of the refrigerating chamber R depending on load of the refrigerating chamber, and so on and repeatedly perform the refrigerating chamber evaporator defrost step and the refrigerating chamber evaporator defrost end step as described above.

Meanwhile, when performing a next refrigerating chamber evaporator defrost step after the defrost error is displayed, if a temperature sensed by the refrigerating defrost sensor 82 becomes below the refrigerating return setting temperature within the refrigerating defrost delay time D2, the controller 60 determines that the refrigerating chamber evaporator 14 is defrosted smoothly in the refrigerating chamber evaporator defrost step and, therefore, stops the display of the defrost error.

Meanwhile, the present invention is not limited to the above embodiments, but three or more storage chambers may be provided in the refrigerator and a temperature of each of the storage chambers can be maintained by each evaporator. Further, a plurality of refrigerating chambers can be provided in the refrigerator and a temperature of each of the refrigerating chambers can be maintained by each evaporator. In addition, a plurality of freezing chambers can be provided in the refrigerator and a temperature of each of the freezing chambers can be maintained by each evaporator.

Industrial Applicability

In the case in which a plurality of storage chambers is cooled by a plurality of evaporators, respectively, and a refrigerant control valve controls refrigerant introduced into the plurality of storage chambers, whether each of the evaporators has been frosted is determined on the basis of an opening integration time of the refrigerant control valve. Accordingly, the present invention can be applied to a refrigerator that is able to efficiently defrost each evaporator at an exact point of time at which defrosting is required.

The invention claimed is:

1. A method of controlling a refrigerator, the refrigerator including a main body having a freezing chamber and a refrigerating chamber, a freezing chamber evaporator installed to cool the freezing chamber, a refrigerating chamber evaporator installed to cool the refrigerating chamber, and a refrigerant control valve for controlling refrigerant flow into the freezing chamber evaporator and the refrigerating chamber evaporator, the method comprising:

opening the refrigerant control valve and allowing refrigerant to flow into at least one of the freezing chamber evaporator or the refrigerating chamber evaporator;

when a freezing chamber evaporator opening integration time of the refrigerant control valve is greater than a first freezing defrost setting time, operating the refrigerator in a freezing chamber evaporator defrost mode;

when a temperature sensed by a freezing defrost sensor is greater than a freezing return setting temperature after operation in the freezing chamber evaporator defrost mode has begun, terminating operation in the freezing chamber evaporator defrost mode of the refrigerator;

after terminating operation in the freezing chamber evaporator defrost mode and in response to another freezing chamber evaporator opening integration time of the refrigerant control valve being greater than a second freezing defrost setting time, operating the refrigerator in the freezing chamber evaporator defrost mode, wherein the first freezing defrost setting time is set to be less than the second freezing defrost setting time, wherein operating the refrigerator in a freezing chamber evaporator defrost mode comprises turning off a compressor and turning on a freezing defrost heater for defrosting the freezing chamber evaporator, and wherein terminating operation in the freezing chamber evaporator defrost mode comprises turning off the freezing defrost heater, wherein the freezing return setting temperature is selected, from a plurality of freezing return setting temperatures, based on an ambient temperature, and wherein the selected freezing return setting temperature is compared with the temperature sensed by the freezing defrost sensor; and forcibly terminating operation in the freezing chamber evaporator mode by turning off the freezing defrost heater at an end of a freezing defrost delay time when the temperature sensed by the freezing defrost sensor does not become higher than the freezing return setting temperature within the freezing defrost delay time.

2. The method according to claim 1, wherein forcibly terminating operation in the freezing chamber evaporator defrost mode further comprises displaying a defrost error indication.

3. The method according to claim 2, wherein:

operating in the freezing chamber evaporator defrost mode and terminating operation in the freezing chamber evaporator defrost mode are repeatedly performed, and when operation in the freezing chamber evaporator defrost mode is initiated again after the defrost error is displayed, if the temperature sensed by the freezing defrost sensor becomes lower than the freezing return setting temperature within the freezing defrost delay time, the defrost error indication is no longer displayed.

4. A method of controlling a refrigerator, the refrigerator including a main body having a freezing chamber and a refrigerating chamber, a freezing chamber evaporator installed to cool the freezing chamber, a refrigerating chamber evaporator installed to cool the refrigerating chamber, and a refrigerant control valve for controlling refrigerant introduced into the freezing chamber evaporator and the refrigerating chamber evaporator, the method comprising:

opening the refrigerant control valve and allowing refrigerant to flow into at least one of the freezing chamber evaporator or the refrigerating chamber evaporator;

performing a freezing chamber evaporator defrost step, comprising operating the refrigerator in a freezing chamber evaporator defrost mode when a freezing chamber evaporator opening integration time of the refrigerant control valve is greater than a first freezing defrost setting time;

performing a freezing chamber evaporator defrost end step, comprising terminating operation in the freezing chamber evaporator defrost mode when a temperature sensed by a freezing defrost sensor is higher than a freezing return setting temperature after the refrigerator begins operating in the freezing chamber evaporator defrost mode, wherein performing a freezing chamber evaporator defrost step further comprises turning off a compressor and turning on a freezing defrost heater for defrosting the freezing chamber evaporator, and performing a freezing chamber evaporator defrost end step further comprises turning off the freezing defrost heater, wherein the freezing return setting temperature is selected, from a plurality of freezing return setting temperatures, based on an ambient temperature, and is compared to the temperature sensed by the freezing defrost sensor; and after performing the freezing chamber evaporator defrost step, operating the refrigerator in the freezing chamber evaporator defrost mode when another freezing chamber evaporator opening integration time of the refrigerant control valve is greater than a second freezing defrost setting time, wherein the first freezing defrost setting time is set to be less than the second freezing defrost setting time; and forcibly terminating operation in the freezing chamber evaporator defrost mode by turning off the freezing defrost heater at an end of a freezing defrost delay time when the temperature sensed by the freezing defrost sensor does not become higher than the freezing return setting temperature within the freezing defrost delay time.

5. The method according to claim 4, wherein forcibly terminating operation in the freezing chamber evaporator defrost mode further comprises displaying a defrost error indication.

6. The method according to claim 5, wherein the refrigerant control valve opening step, the freezing chamber evaporator defrost step, and the freezing chamber evaporator defrost end step are repeatedly performed, and, when a next freezing chamber evaporator defrost step is performed after displaying the defrost indication, if the temperature sensed by the freezing defrost sensor becomes lower than the freezing return setting temperature within the freezing defrost delay time, the defrost error indication is no longer displayed.

7. The method according to claim 1, wherein the first freezing defrost setting time is for a first one-time frosting, and the second freezing defrost setting time is for a subsequent one-time frosting.

8. The method according to claim 5, wherein the first freezing defrost setting time is for a first one-time frosting, and the second freezing defrost setting time is for a subsequent one-time frosting.

* * * * *